United States Patent [19]

Suzuki et al.

[11] Patent Number: 4,973,877

[45] Date of Patent: Nov. 27, 1990

[54] LOW-VOLTAGE TYPE IGNITER PLUG HAVING SEMI-CONDUCTOR STRUCTURE FOR USE IN JET AND OTHER INTERNAL COMBUSTION ENGINES

[75] Inventors: Takahiro Suzuki; Yuki Izuoka; Noboru Aoki; Shuzo Matsumura, all of Nagoya, Japan

[73] Assignee: NGK Spark Plug Co., Ltd., Nagoya, Japan

[21] Appl. No.: 361,935

[22] Filed: Jun. 5, 1989

[30] Foreign Application Priority Data

Sep. 29, 1988 [JP] Japan ..... 63-245762

[51] Int. Cl.[5] ..... H01T 13/20; H01T 13/39

[52] U.S. Cl. ..... 313/131 A; 313/131 R

[58] Field of Search ..... 313/130, 131 R, 131 A, 313/141, 141.1

[56] References Cited

U.S. PATENT DOCUMENTS 2,266,318 12/1941 Heller ..... 313/141.1

2,326,028 8/1943 Griffiths ..... 313/141.1

2,786,158 3/1957 Tognola ..... 313/131 R 3,558,959 1/1971 Ziemendorf ..... 313/130

4,007,391 2/1977 Baker ..... 313/131 A

*Primary Examiner*—Sandra L. O'Shea

*Attorney, Agent, or Firm*—Cooper & Dunham

[57] ABSTRACT

A low-voltage type igniter plug having semi-conductor structure for use in jet and other internal combustion engines comprising; the semi-conducting body mounted adjacent a spark-gap in electrically contact with both center and ground electrodes, and essentially consisting of silicon carbide particles less than 5 microns in average diameter, and alumina particles less than 1 micron in average diameter, the weight percentages of the silicon carbide particles ranging from 65 to 80, the weight percentages of the alumina particles ranging from 20 to 35, the silicon carbide particles and the alumina particles being mixed with an addition of suitable binder means, and hot pressed at the temperature above 1800 degrees Celsius, and at the pressure above 200 Kg/cm$^2$.

7 Claims, 3 Drawing Sheets

LOW-VOLTAGE TYPE IGNITER PLUG HAVING SEMI-CONDUCTOR STRUCTURE FOR USE IN JET AND OTHER INTERNAL COMBUSTION ENGINES

BACKGROUND OF THE INVENTION

1. Field of the Invention

This invention relates to a low-voltage type igniter plug having semi-conductor structure for use in jet and other internal combustion engines in which the semi-conductor structure is particularly improved.

In jet engine igniters, an electrically semi-conducting material is mounted within a spark gap between firing-tip of a center electrode and a ground electrode. The semi-conducting material allows for limited current flow to occur along the surface of the semi-conducting material upon application of a low voltage, the current flow causes the requisite ionization and enables a high energy spark discharge with the low applied voltage.

Various semi-conducting materials have heretofore been introduced, and extensively used in igniters fired by low-voltage, high-energy ignition systems.

One example of the semi-conducting materials was disclosed in the specification of U.S Pat. No. 3,558,959 filed Apr. 24, 1968 as continuation-in-part, and patented Jan. 26, 1971.

According to the publication of U.S. Pat. No. 3,558,959, a ceramic semi-conductor body is hot-pressed with silicon carbIde (SiC) and alumina ($A1_2 0_3$) as essential components which is found to be adequate under severe service condition, in particular high combustion zone temperatures and fuel wetted condition encountered in many those day engines.

In recent years, however, it is demanded for the igniter plug to normally function under a high pressure such as, for example, 20Kg/cm$^2$ for the purpose of safety.

Under such circumstances, there is possibility that no small amount of erosion will occur even in the semiconductor body carried by U.S. Pat. No. 3,558,959.

Therefore, it is an object of this invention to provide a low-voltage type igniter plug having semi-conductor structure improved to have significantly long service lives when assembled to provide a semi-conductor surface along which a high energy spark discharge occurs in a low voltage under the high pressure.

According to the present invention, there is provided a low-voltage type igniter plug having semi-conductor structure comprising; a center electrode having a firing-tip mounted within a tubular insulator which in turn are placed within an interior of a metallic shell; a ground electrode being electrically contact with the metallic shell and in spaced, a spark-gap relationship with the firingtip of the center electrode; an electrically semi-conducting body, surface of which is mounted adjacent the spark-gap in electrically contact with both the center and ground electrodes; the improvement in which the semi-conducting body essentially consisting of silicon carbide particles less than 5 microns in average diameter, and alumina particles less than 1 micron in average diameter, the weight percent of the silicon carbide particles ranging from 65 to 80 inclusive, the weight percent of the alumina particles ranging from 20 to 35 inclusive, the silicon carbide particles and the alumina particles being mixed with an addition of suitable amount of binder means, and sintered by means of hot press at the temperature above 1800 degrees Celsius inclusive, and at the pressure above 200Kg/cm$^2$ inclusive.

Thus providing a tough-structured conductor body of nearly 1 in theoretic density in which particles are aligned in well-ordered manner with small number of defects, enabling to decrease the amounts of erosion even when the semi-conducting body is exposed to a spark discharge under the high pressure.

Other object and advantages will be apparent with reference to the following specification, attendant claims, and drawings.

DETAILED DESCRIPTION OF THE INVENTION

Figure 1:
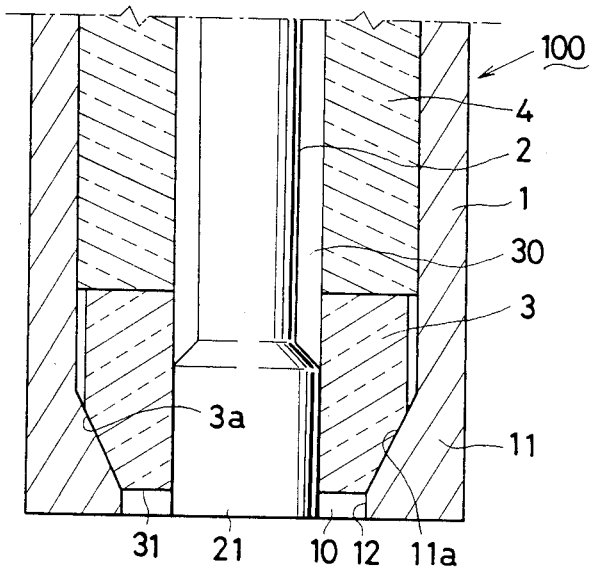
FIG. 1 is a partially schematic view in longitudinal cross section showing a firing tip of an igniter plug according to the invention.

Referring now to FIG. 1 which sectionally shows a leading portion of an igniter plug 100, a metallic shell designated by numeral 1 has a leading portion 11 as seen lower part of the drawing. The leading portion 11 has a tapered surface 11*a* at its inner wall to act as a ground electrode, the leading end of which is terminated at an annular end 12 of 6.4 mm in diameter. Within the metallic shell 1, is a center electrode 2 coaxially placed, the leading end of which terminates in a radially enlarged head 21 of 4.0 mm in diameter to form an annular spark gap 10 with an inner wall of the annular end 12 somewhat extended from the metallic shell 1. Upper part of the center electrode 2 is seated in a tubular insulator 4 disposed within a space 30 between the center electrode 2 and metallic shell 1. The dimensional relationship between annular end 12 and head 21 is such as to provide a compact igniter plug.

In the meanwhile, an electrically semi-conducting body 3 is generally formed into annular-shape, and extends annularly around the lower extremity of the insulator 4 to the tapered surface 11*a* of the metallic shell 1.

In this instance, the lower corner of the body 3 is beveled to form a frustoconical surface 3*a* in general, so that the frustoconical surface 3*a* is brought into engagement with the tapered surface 11*a* at the time of assemble.

Both the tapered surface 11*a* and the head 21 of the center electrode 2 are in electrical contact with a lower end surface 31 of the body 3, so that the current flow along the lower end surface 31 of the body 3 ionizes adjacent air, and enables a high-energy low voltage spark 2 Kilo volt for example) to occur.

The semi-conducting body 3 is manufactured as follows:

First step: Taking silicon carbide powder ranging from 65% to 80% by weight, and alumina ranging from 20% to 35% by weight, and mixing these two components of the powders in a tumbling mill for three hours with an addition of binder means such as magnesia (0.3% by weight), calcium oxide (0.5% by weight), silicate dioxide (1.9% by weight), and further adding a suitable amount of distilled water, and polyvinyl alcohol (0.5% by weight) as an organic binder.

Second step: these powders mixed as above, are rolled after desiccated to obtain the powder particles of around 450 microns which contains silicon carbide particles of less than 5 microns in average diameter, and alumina particles of less than 1 micron in average diameter. Then, the powders are pressed by means of steel mould under the pressure of 2000 $Kg/cm^2$.

Third step: the moulded powders is forced into carbon die to be sintered by means of hot press under the following condition:

(1) Heating the moulded powders at the rate of 20 degrees Celsius per minute, and press them at the pressure of 150~250 $Kg/cm^2$ when reached to 1200 degrees Celsius.

(2) Holding the above pressure for half hours within the temperature ranging from 1700 to 1900 degrees Celsius.

(3) Gradually cooling the moulded powders, and take the sintered powders of the mould when cooled below 1400 degrees Celsius.

Forth step: the sintered Powders taken out of the mould, is adequately ground into the annular electrically semi-conducting body 3 dimensionally adapted to be incorporated into the igniter plug 100.

Now, the igniter plug 100 is connected to a capacitor-discharge type exciter (not shown) capable of 4 joules, and operated under a pressurized atmosphere of 25 $Kg/cm^2$ to experimentally measure erosion rate of the body 3.

The erosion of the body 3 is expressed by the weight loss caused from the spark discharge of 1000 cycles as a unit.

Figure 2:
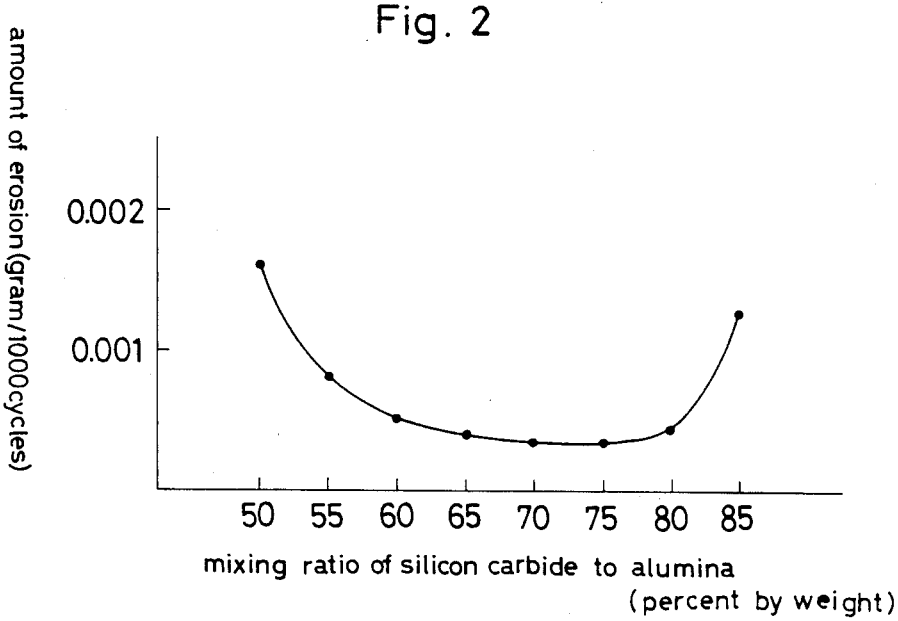
FIG. 2 is a graph showing how an amount of erosion decreases depending on changes of mixing ratio of alumina and silicon carbide.

FIG. 2 shows how the erosion rate (gram) changes depending upon changes of the mixing ratio of silicon carbide particles and alumina particles with the former and latter particles as being in turn 2.0 and 0.4 microns in average diameter.

The temperature and pressure are taken as 1850 degrees Celsius, and 250 $Kg/cm^2$ at the time of sintering.

As a result, significantly reduced amount of erosion has found when the weight percentages of the silicon carbide particles ranges from 65 to 80, while that of the alumina particles being from 20 to 35 as apparently seen in FIG. 2.

Figure 3:
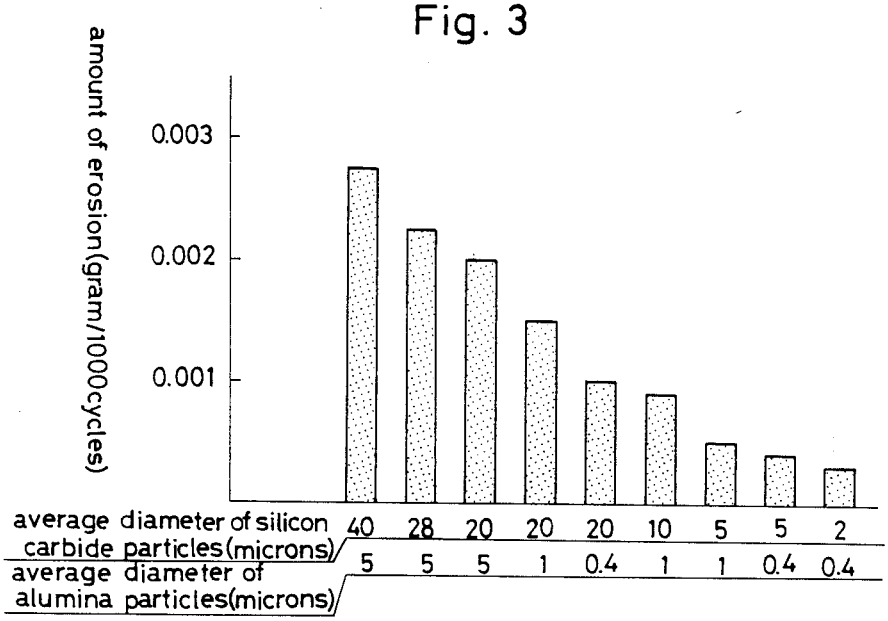
FIG. 3 is a graph showing how an amount of erosion decreases depending on changes of diameters of alumina and silicon carbide particles mixed together.

Further, FIG. 3 shows how the erosion rate (gram) changes depending upon changes of the average diameter the silicon carbide particles, and alumina particles with the weight percentages of the former and latter particles as being, in turn, 65 and 35.

The temperature and pressure are taken as 1850 degrees Celsius, and 250 $Kg/cm^2$ at the time of sintering in the same manner as mentioned above.

As a result, drastically reduced amount of erosion has found when the average diameter of the silicon carbide particles is less than 5 microns, while that of the alumina particles being less than 1 micron as readily seen in FIG. 3.

Figure 4:
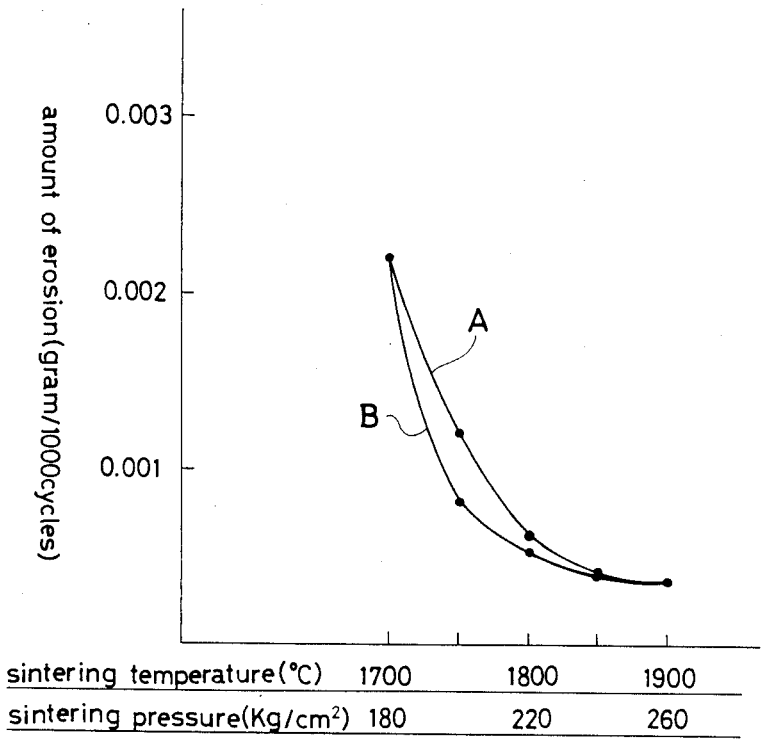
FIG. 4 is a graph showing how an amount of erosion decreases depending on sintering temperature and pressure.

FIG. 4 shows how the erosion rate gram changes depending upon changes of the temperature and pressure at the time of sintering with the weight percentages of the silicon carbide particles and alumina particles as 65% and 35% in turn.

In this instance, the silicon carbide particles and alumina particles are in-turn taken as 2 microns and 0.4 microns in average diameter Under these conditions, the amount of erosion (gram) changes depending upon the pressure ($Kg/cm^2$) as designated by curve (A) at the constant temperature 1850 degrees Celsius, and at the same time, changing depending upon the temperature as designated by curve (B) at the constant pressure 250 Kg/cm .

By paying attention to the curves (A) and (B) of FIG. 4, it is found that the amount of erosion drastically reduces to less than 0.001 (gram) when the semi-conducting body 3 is sintered at the temperature of more than 1800 degrees Celsius and at the pressure of more than 200 $Kg/cm^2$.

Figure 5:
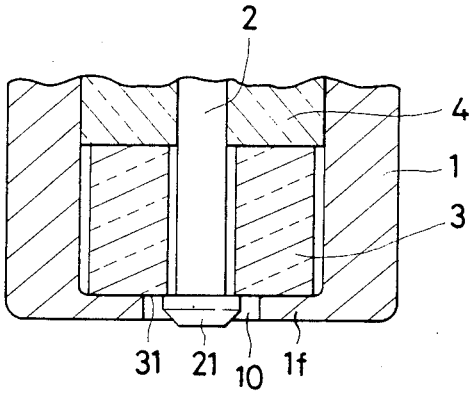
FIG. 5 is a view similar to FIG. 1 according to a modified igniter of the invention.

FIG. 5 shows a modified igniter plug according to the invention, in which the head 21 of a center electrode 2 has an axially reduced dimension, and a metallic shell 1 terminates in a circular flange 1f surrounding the head 21.

The electrically semi-conducting body 3 extends annularly around the lower extremity of the insulator 4 to an inner side of the flange 1f of the metallic shell 1.

Both the flange 1f and the head 21 of the center electrode 2 are in electrical contact with the lower end surface 31 of the body 3, so that the current flow along the lower end surface 31 of the body 3 ionizes adjacent air, and enables a high-energy low voltage spark to occur.

It noted that a suitable combination of the binder components may be selected among magnesia, calcium oxide, silicate dioxide, proper amount of distilled water, and polyvinyl alcohol.

It is further appreciated that a firing-tip of the center electrode may be made of tungsten based alloy, or platinum-Indium based alloy to impart corrosion resistant properties to the firing tip.

The ground electrode integrally extended from the metallic shell may be made of nickel-chromium-based alloy to impart corrosion resistance to the ground electrode.

It will be apparent that various changes and modifications can be made from the specific details of the invention as set forth herein without departing from the spirit and scope of the attached claims.

What is claimed is:

1. A low voltage type igniter plug having semi-conductor structure for use in jet and other internal combustion engines comprising;

a center electrode having a firing-tip mounted within a tubular insulator which in turn are placed within an interior of a metallic shell;

a ground electrode in electrical contact with the metallic shell and in spaced, spark-gap relationship with the firing-tip of the center electrode;

an electrically semi-conducting body, the surface of which is mounted adjacent the spark-gap in electrical contact with both the center and ground electrodes;

the improvement in which the semi-conducting body consists of silicon carbide particles of less than 5 microns in average diameter and alumina particles of less than 1 micron in average diameter, the weight percent f the silicon carbide particles in said body ranging from 64 to 80 inclusive;

the weight percentages of the alumina particles in said body ranging from 20 to 35 inclusive.

2. In a low-voltage type igniter plug having semi-conductor structure for use in jet and other internal combustion engines are recited in claim 1, wherein said silicon carbide particles are bound by binder means selected from the group consisting of magnesia, calcium oxide and silicon dioxide, and the group consisting of polyvinyl alcohol and a suitable amount of distilled water.

3. In a low-voltage type igniter plug having semi-conductor structure for use in jet and other internal combustion engines as recited in claim 2, wherein the weight percentages of the magnesia, calcium oxide and silicon dioxide are, in turn, 0.3, 0.5 and 1.9 while the weight percentage of the polyvinyl alcohol is approximately 0.5.

4. In a low-voltage type igniter plug having semi-conductor for use in jet and other internal combustion engines as recited in claim 1, the firing-tip of the center electrode is made of tungsten based alloy, or platinum-Indian based alloy to impart corrosion resistance to the firing tip.

5. In a low-voltage type igniter plug having semi-conductor structure for use in jet and other internal combustion engines as recited in claim 1, wherein the center electrode has a diameter-enlarged head, and surrounded by the leading end of the metallic shell.

6. In a low-voltage type igniter plug having semi-conductor structure for use in jet and other internal combustion engines as recited in claim 5, the diameter of the head is determined to be approximately 4.0 mm, while an inner diameter of the leading end being approximately 6.4 mm to provide a compact igniter plug.

7. In a low-voltage type igniter plug having semi-conductor structure for use in jet and other internal combustion engines as recited in claim 1, the ground electrode integrally extended from the metallic shell is made of nickel-chromium-iron based alloy to provide corrosion resistance properties.

* * * * *